US012104832B2

(12) United States Patent
Hamadate et al.

(10) Patent No.: US 12,104,832 B2
(45) Date of Patent: Oct. 1, 2024

(54) REFRIGERATION APPARATUS WITH STAINLESS STEEL FOUR-WAY SWITCHING VALVE AND STAINLESS STEEL PIPES CONNECTED THERETO

(71) Applicant: DAIKIN INDUSTRIES, LTD., Osaka (JP)

(72) Inventors: Junichi Hamadate, Osaka (JP); Masanori Jindou, Osaka (JP); Yoshihiro Teramoto, Osaka (JP); Hiroaki Matsuda, Osaka (JP); Masato Okuno, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 283 days.

(21) Appl. No.: 17/586,273

(22) Filed: Jan. 27, 2022

(65) Prior Publication Data

US 2022/0146159 A1 May 12, 2022

Related U.S. Application Data

(63) Continuation of application No. PCT/JP2020/022332, filed on Jun. 5, 2020.

(30) Foreign Application Priority Data

Jul. 31, 2019 (JP) ..... 2019-141770
Dec. 25, 2019 (JP) ..... 2019-234825

(51) Int. Cl.
*F25B 41/26* (2021.01)
*F24F 1/26* (2011.01)
(Continued)

(52) U.S. Cl.
CPC ..... *F25B 41/26* (2021.01); *F24F 1/26* (2013.01); *F24F 13/24* (2013.01); *F25B 13/00* (2013.01);
(Continued)

(58) Field of Classification Search
CPC .. F25B 41/26; F25B 2400/23; F25B 2500/11; F25B 2500/12; F24F 1/26
See application file for complete search history.

(56) References Cited

U.S. PATENT DOCUMENTS 1,941,465 A 1/1934 Cornell, Jr.
2,249,469 A 7/1941 Gray et al.
(Continued)

FOREIGN PATENT DOCUMENTS

CN 201191112 Y 2/2009
CN 102853513 A 1/2013
(Continued)

OTHER PUBLICATIONS

Extended European Search Report issued in related European Patent Application No. 20847177.1, dated Aug. 2, 2022 (9 pages).
(Continued)

*Primary Examiner* — Jonathan Bradford
(74) *Attorney, Agent, or Firm* — Osha Bergman Watanabe & Burton LLP

(57) ABSTRACT

A refrigeration apparatus includes: a casing that houses a compressor therein; a four-way switching valve; an accumulator; a first pipe that causes a refrigerant to flow between the four-way switching valve and a discharge portion of the compressor; and a second pipe that causes a refrigerant to flow between the four-way switching valve and the accumulator. The four-way switching valve, the first pipe, and the second pipe are all made of stainless steel.

8 Claims, 10 Drawing Sheets

(51) Int. Cl.
*F24F 13/24* (2006.01)
*F25B 13/00* (2006.01)
*F25B 43/02* (2006.01)

(52) U.S. Cl.
CPC ..... *F25B 43/02* (2013.01); *F25B 2313/02741* (2013.01); *F25B 2400/23* (2013.01); *F25B 2500/11* (2013.01); *F25B 2500/12* (2013.01)

(56) References Cited

U.S. PATENT DOCUMENTS

| | | | | |
|---|---|---|---|---|
| 3,971,500 | A | 7/1976 | Kushner et al. | |
| 4,212,931 | A | 7/1980 | Cadart et al. | |
| 5,228,727 | A | 7/1993 | Tokutake et al. | |
| 2011/0017319 | A1* | 1/2011 | Zhang ..... | F16K 27/048 29/890.131 |
| 2018/0259226 | A1 | 9/2018 | Hong | |

FOREIGN PATENT DOCUMENTS

| | | | |
|---|---|---|---|
| CN | 102873508 | A | 1/2013 |
| CN | 203036155 | U | 7/2013 |
| CN | 203869386 | U | 10/2014 |
| CN | 102962633 | B | 9/2015 |
| CN | 205001726 | U | 1/2016 |
| CN | 205781506 | U | 12/2016 |
| CN | 206889747 | U | 1/2018 |
| CN | 109954996 | A | 7/2019 |
| EP | 1684033 | A1 | 7/2006 |
| JP | 652-009860 | U | 1/1977 |
| JP | 653-060836 | A | 5/1978 |
| JP | H05-094593 | U | 12/1993 |
| JP | 2000-009368 | A | 1/2000 |
| JP | 2005-121131 | A | 5/2005 |
| JP | 2009-109122 | A | 5/2009 |
| JP | 2010-091202 | A | 4/2010 |
| JP | 2010-151327 | A | 7/2010 |
| JP | 2016-001097 | A | 1/2016 |
| JP | 5927414 | B2 | 6/2016 |
| JP | 2016-130594 | A | 7/2016 |
| JP | 2017-137961 | A | 8/2017 |
| JP | 2018-141448 | A | 9/2018 |
| JP | 2019-124402 | A | 7/2019 |
| KR | 101837909 | B1 | 3/2018 |

OTHER PUBLICATIONS

International Preliminary Report on Patentability issued in corresponding International Application No. PCT/JP2020/020502, mailed on Feb. 10, 2022 (5 pages).

International Preliminary Report on Patentability issued in corresponding International Application No. PCT/JP2020/022332, mailed on Feb. 10, 2022 (6 pages).

Extended European Search Report issued in corresponding European Patent Application No. 20847598.8, dated Aug. 16, 2022 (8 pages).

International Search Report issued in corresponding International Application No. PCT/JP2020/022332, mailed on Aug. 25, 2020 (6 pages).

International Search Report issued in related International Application No. PCT/JP2020/020502, mailed on Aug. 11, 2020 (6 pages).

* cited by examiner

REFRIGERATION APPARATUS WITH STAINLESS STEEL FOUR-WAY SWITCHING VALVE AND STAINLESS STEEL PIPES CONNECTED THERETO

TECHNICAL FIELD

The present disclosure relates to a refrigeration apparatus. More specifically, the present disclosure relates to a refrigeration apparatus including a switching mechanism that switches a refrigerant flow path.

BACKGROUND

In a refrigeration apparatus such as an air conditioner or an air conditioning system, a four-way switching valve is used to switch a refrigerant flow path. In order to suppress heat transfer in such a four-way switching valve, it is known to use stainless steel, which has a lower thermal conductivity than copper, as a material of the four-way switching valve (see, for example, Patent Document 1).

In the four-way switching valve described in Patent Literature 1, a four-way switching valve main body and a short pipe (conduit) extending from the main body are made of stainless steel, and a copper pipe is connected to a tip of the conduit.

PATENT LITERATURE

Patent Literature 1: Japanese Unexamined Patent Publication No. 2017-137961

SUMMARY

A refrigeration apparatus according to the present disclosure includes a casing that houses a compressor therein; a four-way switching valve; an accumulator; a first pipe that causes a refrigerant to flow between the four-way switching valve and a discharge portion of the compressor; and a second pipe that causes a refrigerant to flow between the four-way switching valve and the accumulator, wherein the four-way switching valve, the first pipe, and the second pipe are made of stainless steel.

DETAILED DESCRIPTION

Hereinafter, a refrigeration apparatus of the present disclosure will be described in detail with reference to the accompanying drawings. The present disclosure is not limited to the following exemplary description, and all changes that fall within metes and bounds of the claims, or equivalence such metes and bounds thereof are therefore intended to be embraced by the claims.

[Air Conditioner A]

Figure 1:
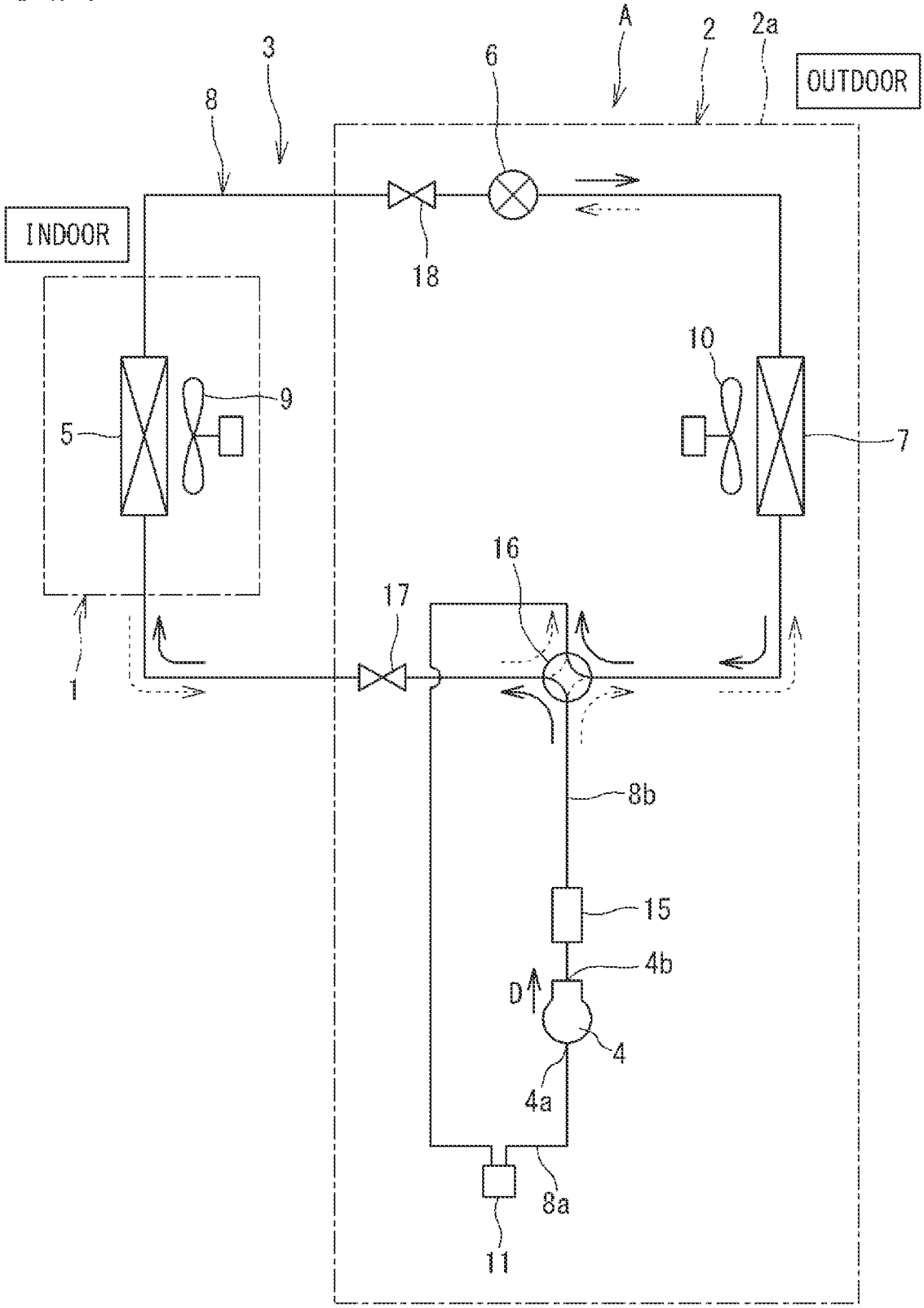
FIG. 1 is a schematic configuration diagram of a refrigeration apparatus according to one or more embodiments of the present disclosure.

FIG. 1 is a schematic configuration diagram of an air conditioner A as a refrigeration apparatus according to one or more embodiments of the present disclosure. The air conditioner A adjusts temperature and humidity in an air-conditioned room by a vapor compression refrigeration cycle. The air conditioner A includes an indoor unit 1 installed within the room and an outdoor unit 2 installed outside the room. The indoor unit 1 and the outdoor unit 2 are connected to each other by a refrigerant pipe 8.

The air conditioner A includes a refrigerant circuit 3 that performs the vapor compression refrigeration cycle. The refrigerant circuit 3 includes a plurality of components and the refrigerant pipe 8 connecting the plurality of components.

The refrigerant circuit 3 includes a compressor 4 that compresses a refrigerant and generates a high-temperature and high-pressure gas refrigerant, an indoor heat exchanger 5, an electronic expansion valve 6 that decompresses the refrigerant, an outdoor heat exchanger 7, an accumulator 11, a muffler 15, a four-way switching valve 16, and the like, which are connected by the refrigerant pipe 8. The compressor 4, the indoor heat exchanger 5, the electronic expansion valve 6, the outdoor heat exchanger 7, the accumulator 11, the muffler 15, the four-way switching valve 16, and a gas shutoff valve and a liquid shutoff valve to be described later are devices and components constituting the air conditioner A, and are connected to other devices and components by the refrigerant pipe 8. In the present specification, these devices and components are also referred to as components constituting the refrigeration apparatus.

The compressor 4 compresses a low-pressure gas refrigerant and generates a high-pressure gas refrigerant. The compressor 4 has a suction port or a suction portion 4*a* and a discharge port or a discharge portion 4*b*. The low-pressure gas refrigerant is suctioned through the suction portion 4*a*. The high-pressure gas refrigerant is discharged through the discharge portion 4*b* in the direction of arrow D. As the compressor 4, various compressors such as a scroll compressor can be adopted, for example. The compressor 4 is fixed to a bottom plate or the like of a casing 2*a* of the outdoor unit 2.

The indoor heat exchanger 5 is provided for the indoor unit 1, and exchanges heat between the refrigerant and air within the room. As the indoor heat exchanger 5, a cross-fin type fin-and-tube heat exchanger, a microchannel heat exchanger, or the like can be adopted, for example. An indoor fan 9 for sending air within the room to the indoor heat exchanger 5 and sending conditioned air into the room is disposed near the indoor heat exchanger 5.

The electronic expansion valve 6 is provided for the refrigerant pipe 8 of the refrigerant circuit 3 between the outdoor heat exchanger 7 and the indoor heat exchanger 5, and expands inflowing refrigerant to decompress the refrigerant to a predetermined pressure.

The outdoor heat exchanger 7 exchanges heat between the refrigerant and outdoor air. As the outdoor heat exchanger 7, a cross-fin type fin-and-tube heat exchanger, a microchannel heat exchanger, or the like can be adopted, for example. An outdoor fan 10 for sending outdoor air to the outdoor heat exchanger 7 is disposed near the outdoor heat exchanger 7.

In one or more embodiments, the accumulator 11 is provided for a refrigerant pipe 8*a* on a suction side of the compressor 4. The accumulator 11 is fixed to the bottom plate or the like of the casing 2*a* of the outdoor unit 2. The muffler 15 for reducing pressure pulsation of the refrigerant discharged from the compressor 4 is provided for a refrigerant pipe 8*b* on a discharge side of the compressor 4.

The refrigerant pipe 8 is provided with the four-way switching valve 16 for switching a refrigerant flow path, a gas shutoff valve 17, and a liquid shutoff valve 18. By switching the four-way switching valve 16, it is possible to reverse a flow of the refrigerant, and to switch the refrigerant discharged from the compressor 4 to be supplied to the outdoor heat exchanger 7 or the indoor heat exchanger 5, and thus an operation can be switched between a cooling operation and a heating operation.

The gas shutoff valve 17 and the liquid shutoff valve 18 are provided for opening or closing the refrigerant path. The opening and closing are performed manually, for example. When the air conditioner A is installed, the gas shutoff valve 17 and the liquid shutoff valve 18 are closed to prevent the refrigerant enclosed in the outdoor unit 2 from leaking outside, for example. On the other hand, when the air conditioner A is used, the gas shutoff valve 17 and the liquid shutoff valve 18 are opened.

During the heating operation of the air conditioner A, by switching the four-way switching valve 16 as indicated by a solid line, the refrigerant flows in a direction indicated by an arrow of the solid line. As a result, the high-pressure gas refrigerant discharged from the compressor 4 in the direction of arrow D passes through the muffler 15 and the four-way switching valve 16, then passes through the gas shutoff valve 17 that is opened, and then enters the indoor heat exchanger 5. The high-pressure gas refrigerant radiates heat while the high-pressure gas refrigerant turns into a high-pressure liquid refrigerant in the indoor heat exchanger 5. The high-pressure liquid refrigerant reaches the electronic expansion valve 6 via the liquid shutoff valve 18 that is opened, and is decompressed by the electronic expansion valve 6. The decompressed refrigerant reaches the outdoor heat exchanger 7, absorbs heat in the outdoor heat exchanger 7, and turns into a low-pressure gas refrigerant. The low-pressure gas refrigerant is suctioned into the compressor 4 via the four-way switching valve 16 and the accumulator 11. During the heating operation, the indoor heat exchanger 5 functions as a radiator, and the outdoor heat exchanger 7 functions as a heat absorber.

On the other hand, during the cooling operation, the flow of the refrigerant is reversed by switching the four-way switching valve 16 as indicated by a dotted line, and the refrigerant flows in a direction indicated by an arrow of the dotted line. As a result, the high-pressure gas refrigerant discharged from the compressor 4 in the direction of arrow D passes through the muffler 15 and the four-way switching valve 16, and then enters the outdoor heat exchanger 7. The high-pressure gas refrigerant radiates heat while the high-pressure gas refrigerant turns into a high-pressure liquid refrigerant in the outdoor heat exchanger 7. The high-pressure liquid refrigerant reaches the electronic expansion valve 6 and is decompressed by the electronic expansion valve 6. The decompressed refrigerant reaches the indoor heat exchanger 5 via the opened liquid shutoff valve 18, absorbs heat in the indoor heat exchanger 5, and turns into a low-pressure gas refrigerant. The low-pressure gas refrigerant is suctioned into the compressor 4 via the gas shutoff valve 17 that is opened, the four-way switching valve 16, and the accumulator 11. During the cooling operation, the indoor heat exchanger 5 functions as a heat absorber, and the outdoor heat exchanger 7 functions as a radiator.

[Air Conditioner B]

Figure 2:
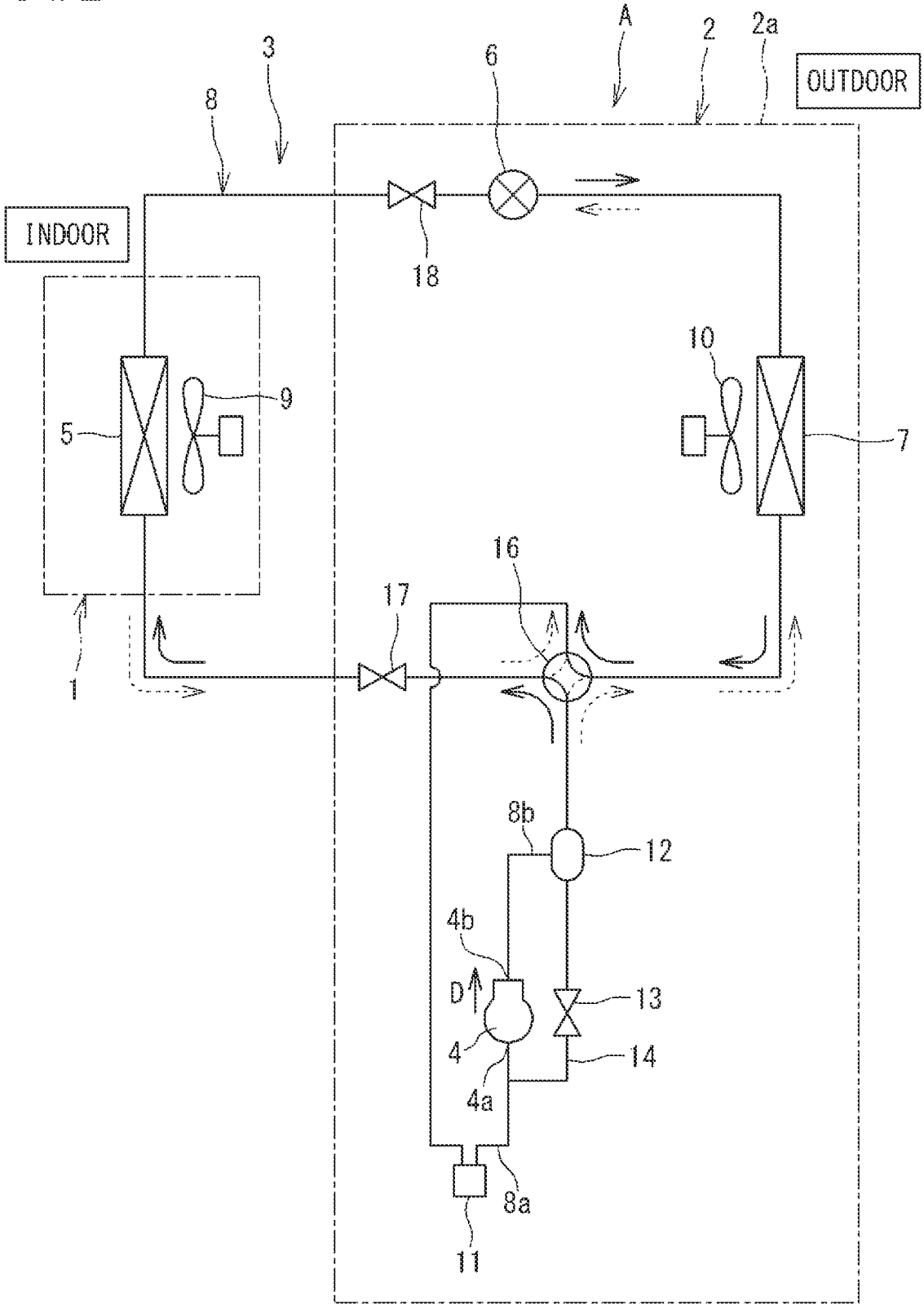
FIG. 2 is a schematic configuration diagram of a refrigeration apparatus according to one or more embodiments of the present disclosure.

FIG. 2 is a schematic configuration diagram of an air conditioner B that is a refrigeration apparatus according to one or more embodiments of the present disclosure. The air conditioner B is provided with an oil separator 12, in place of the muffler 15, in the refrigerant pipe 8*b* on the discharge side of the compressor 4. Oil separated by the oil separator 12 is returned to the refrigerant pipe 8*a* on the suction side of the compressor 4 via an oil return pipe 14 in which the valve 13 is disposed. Configurations other than the oil separator 12, the valve 13, and the oil return pipe 14 are the same as those in the example illustrated in FIG. 1, and common components or elements are denoted by the same reference numerals. For the sake of simplicity, descriptions of the common components or elements shall be omitted. In the example shown in FIGS. 1 to 2, one of the muffler 15 and the oil separator 12 is provided in the refrigerant pipe 8*b* on the discharge side of the compressor 4, but both of the muffler 15 and the oil separator 12 may be provided in the refrigerant pipe 8*b*.

[Switching Mechanism C]

Figure 3:
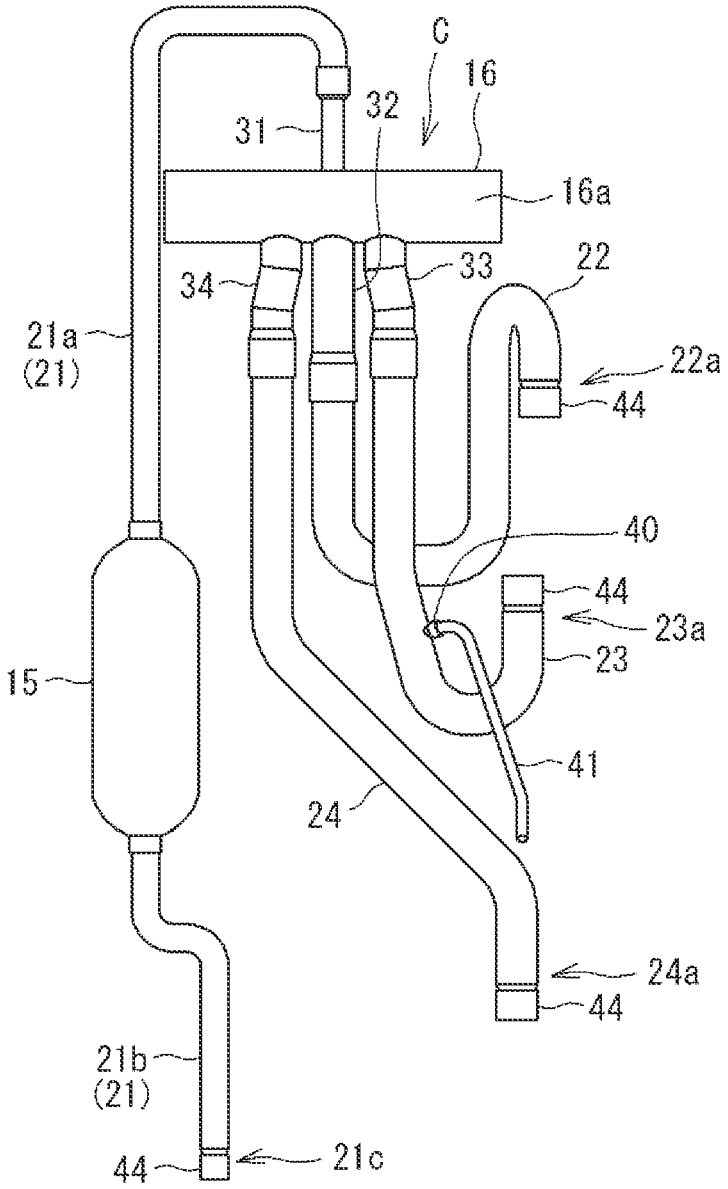
FIG. 3 is an explanatory front view of an example of a switching mechanism.
Figure 4:
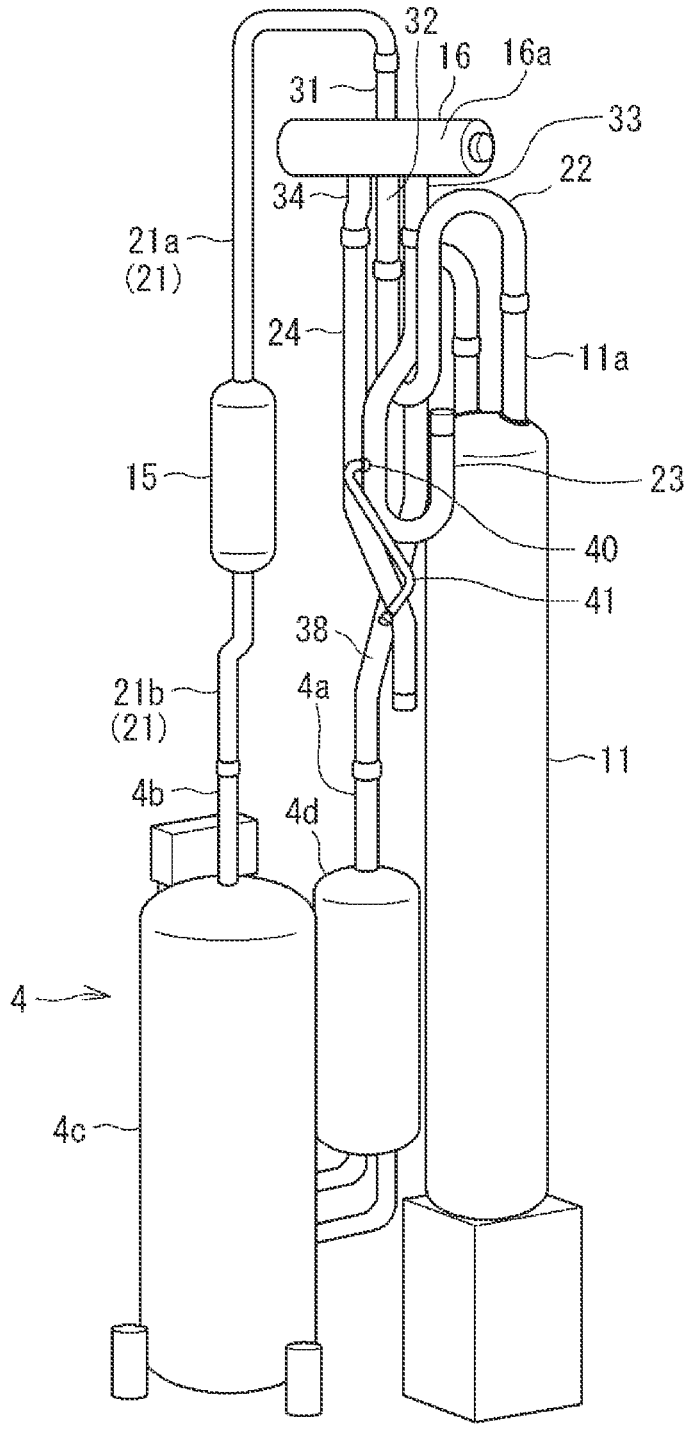
FIG. 4 is an explanatory perspective view around a compressor including the switching mechanism illustrated in FIG. 3.

FIG. 3 is an explanatory front view of a switching mechanism C in the air conditioner devices A and B according to one or more embodiments, and FIG. 4 is an explanatory perspective view around a compressor including the switching mechanism C illustrated in FIG. 3.

The switching mechanism C includes the four-way switching valve 16, and a first pipe 21, a second pipe 22, a third pipe 23, and a fourth pipe 24 that are respectively connected to four ports or connecting ports of the four-way switching valve 16. The four-way switching valve 16 including the four ports and the first to fourth pipes 21, 22, 23, and 24 are made of stainless steel having higher rigidity than copper. In the present specification, "stainless steel" refers to steel in which the content of chromium (Cr) is 10.5 wt % or more and the content of carbon (C) is 1.2 wt % or less. Examples of the stainless steel to be used include SUS304, SUS304L, SUS436L, SUS430 or the like. In one or more embodiments, the switching mechanism includes, not only the four-way switching valve 16, but also the pipes connected to the four ports of the four-way switching valve 16. In other words, a component that can be assembled as a unit or an assembly in advance in a factory or the like and that has a function of switching the refrigerant flow path serves as the switching mechanism. At a site or the like where the outdoor unit 2 is assembled, the switching mechanism C is connected to a connecting portion or a connecting pipe provided for a component such as the compressor 4 or the accumulator 11 by brazing or the like described later.

The four-way switching valve 16 includes a valve main body 16*a* constituting an outer shell, a valve body accommodated in the valve main body 16*a*, and the like. The valve main body 16*a* is made of stainless steel. The four-way switching valve 16 includes four ports that are short pipes and constitute refrigerant inlet and outlet ports, that is, a first port 31, a second port 32, a third port 33, and a fourth port 34. The first to fourth ports 31 to 34 are made of stainless steel. One ends of the first pipe 21, the second pipe 22, the third pipe 23, and the fourth pipe 24 are respectively connected to the first to fourth ports 31 to 34.

In an installed state of the four-way switching valve 16, the first port 31 has an upward posture, and the second to fourth ports 32, 33, and 34 have a downward posture.

Connecting portions 44 made of copper are respectively provided at end portions 22*a*, 23*a*, and 24*a* of the second to fourth pipes 22 to 24 made of stainless steel (end portions on a side opposite to a side of ends connected to the four-way switching valve 16). Further, in one or more embodiments, the muffler 15 is made of stainless steel. The first pipe 21 in one or more embodiments is a pipe that causes the refrigerant to flow between the four-way switching valve 16 and the compressor 4 via the muffler 15, and includes a first pipe 21*a* that connects the first port 31 of the four-way switching valve 16 and the muffler 15, and a first pipe 21*b* that connects the muffler 15 and the discharge portion 4*b* of the compressor 4. The first pipe 21*a* extends upward from the muffler 15 and then turns back to be connected to the first port 31 in the downward posture. For an end portion 21*c* of the first pipe 21*b* (an end portion opposite to a side connected to the muffler 15), a copper connecting portion 44 is provided, similarly to the second to fourth pipes 22 to 24. An example of connection between the end portions 21*c*, 22*a*, 23*a*, and 24*a* and a connecting pipe made of stainless steel of a component such as the compressor 4 will be described later.

The second pipe 22 connects the second port 32 of the four-way switching valve 16 and the connecting pipe 11*a* on an inlet side of the accumulator 11. The second pipe 22 connected to the connecting pipe Ila on the inlet side of the accumulator 11 extends upward, turns back and extends downward, and then turns back again to be connected to the second port 32 in the upward posture. One end of a refrigerant pipe 38 is connected to a connecting pipe (not illustrated) on an outlet side of the accumulator 11, and the other end of the refrigerant pipe 38 is connected to the suction portion of the compressor 4. The refrigerant pipe 38 is also made of stainless steel. The compressor 4 in one or more embodiments includes an auxiliary accumulator 4*d* integrated with a compressor main body 4*c*, and the suction portion 4*a* of the auxiliary accumulator 4*d* functions as the suction portion of the compressor 4.

Figure 5:
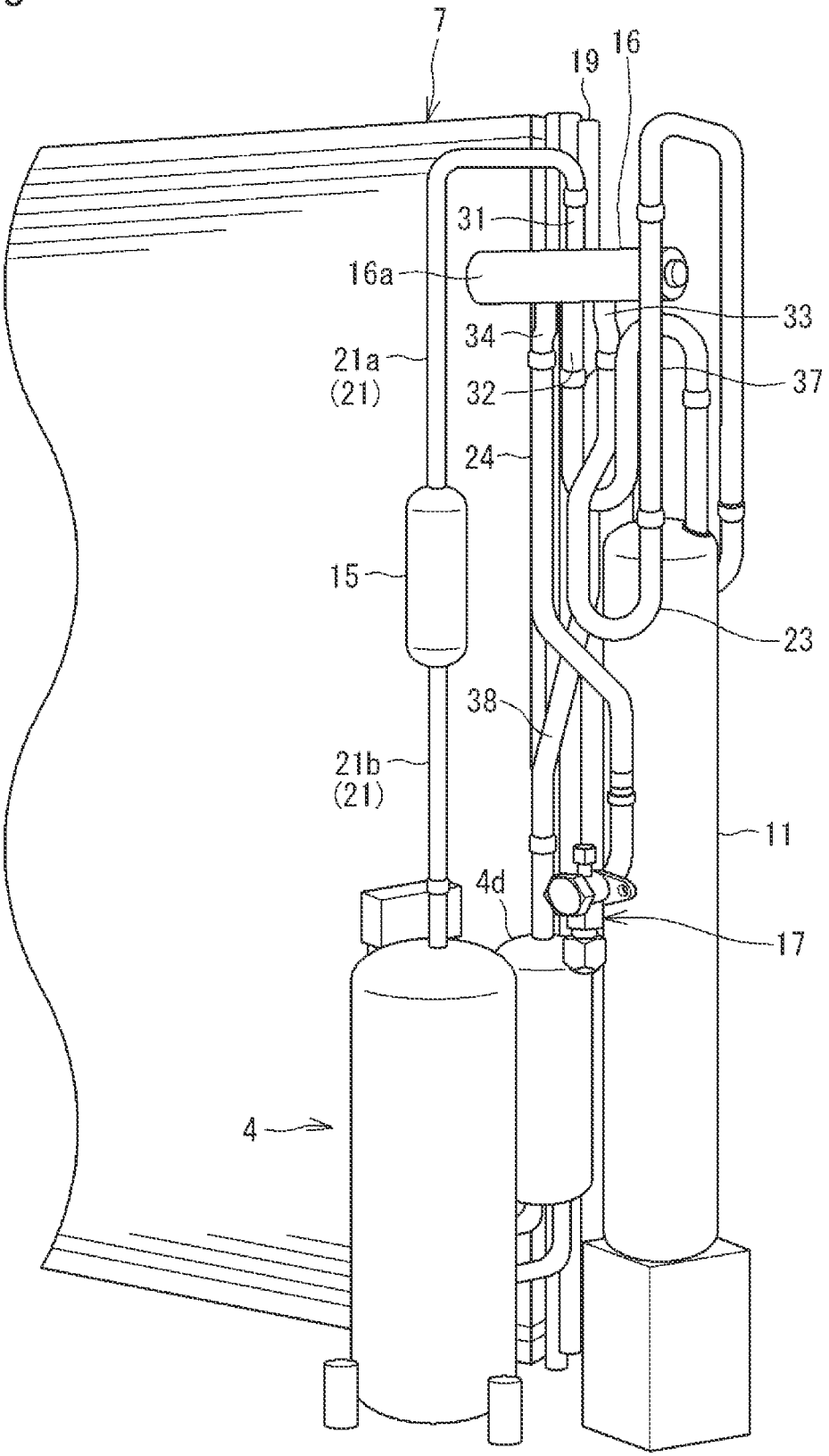
FIG. 5 is an explanatory perspective view around the compressor including the switching mechanism illustrated in FIG. 3 as viewed from a direction different from that in FIG. 4.

FIG. 5 is an explanatory perspective view around the compressor including the switching mechanism C illustrated in FIG. 3 as viewed from a direction different from that in FIG. 4. In FIG. 5, the outdoor heat exchanger 7, the gas shutoff valve 17, and a gas header 19, which are not illustrated in FIG. 4 for the sake of clarity, are illustrated.

The third pipe 23 causes the refrigerant to flow between the gas header 19 of the outdoor heat exchanger 7 and the third port 33 of the four-way switching valve 16. In one or more embodiments, the third pipe 23 is connected to a refrigerant pipe 37 extending from the gas header 19. The third pipe 23 and the gas header 19 can be directly connected without the refrigerant pipe 37. The fourth pipe 24 connects the gas shutoff valve 17 and the fourth port 34 of the four-way switching valve 16.

In the switching mechanism C shown in FIG. 3, the connection between stainless steels and the connection between stainless steel and copper are both performed by furnace brazing. In one or more embodiments, the switching mechanism C as a whole obtained by temporarily assembling the four-way switching valve 16, the muffler 15, the first to fourth pipes 21, 22, 23, and 24, and a copper joint 40 to be described later is introduced into a furnace, and all connecting portions are simultaneously subjected to furnace brazing.

Figure 6:
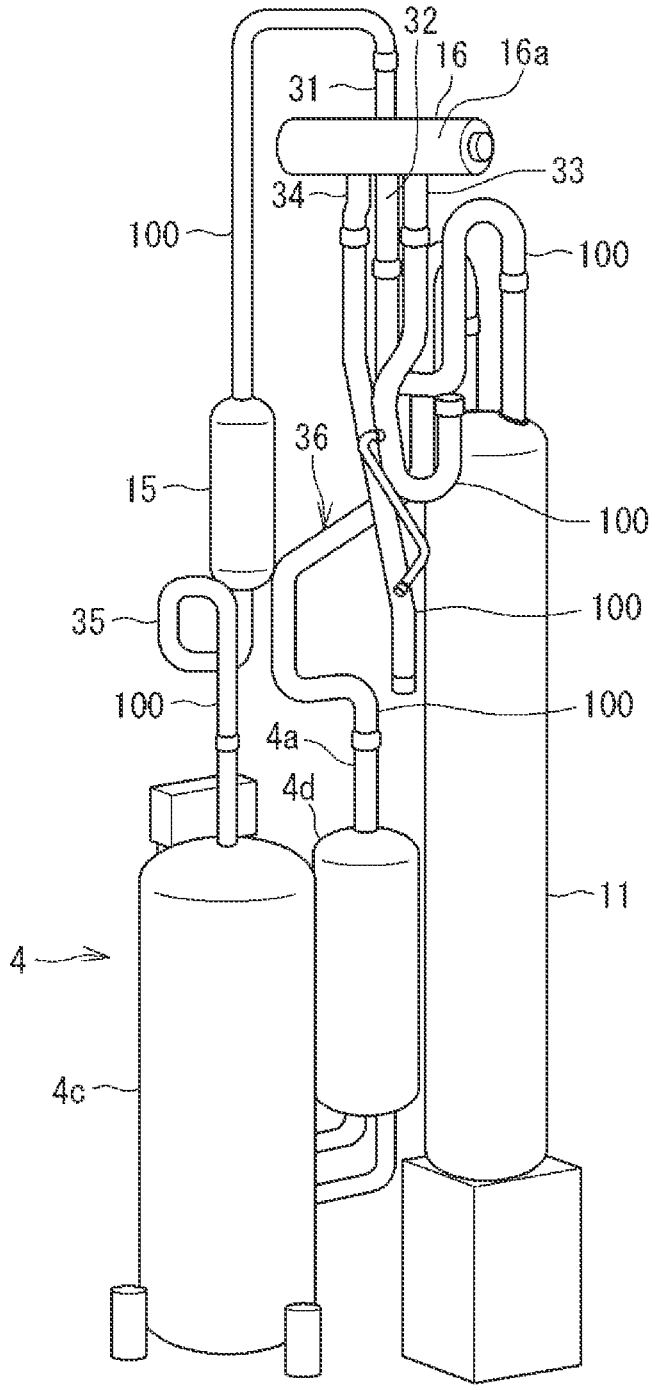
FIG. 6 is an explanatory perspective view illustrating a state in which a switching mechanism according to a comparative example is connected to components.

In one or more embodiments, the first to fourth pipes 21, 22, 23, and 24 extending from the stainless four-way switching valve 16 are made of stainless steel. Therefore, it is possible to simplify the shape of the pipes as compared to the case in which copper pipes are used. FIG. 6 is an explanatory perspective view illustrating a state in which a switching mechanism according to a comparative example is connected to components. In FIG. 6, components or elements common to those in FIG. 4 are denoted by the same reference numerals as those in FIG. 4, and description thereof is omitted for simplicity.

In the switching mechanism illustrated in FIG. 6, the valve main body 16*a* of the four-way switching valve 16 is made of brass, and the first to fourth ports 31 to 34 as well as pipes (refrigerant pipes) 100 corresponding to the first to fourth pipes 21 to 24 illustrated in FIGS. 3 to 4 are made of copper. In the case of this comparative example, as the vibration of the compressor 4 is transmitted to the refrigerant pipes 100 while the strength of the copper refrigerant pipes 100 is low, a structure for absorbing the vibration is required. For example, it is necessary to bend the refrigerant pipes 100 partially to form a loop portion 35 or a bypass portion 36. Therefore, the structure of the refrigerant pipes 100 becomes complicated, and a large space is required for disposing the refrigerant pipes 100.

Figure 7:
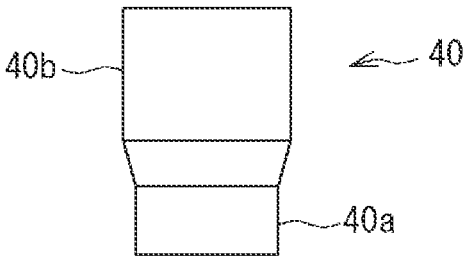
FIG. 7 is an explanatory view of an example of a copper joint.
Figure 8:
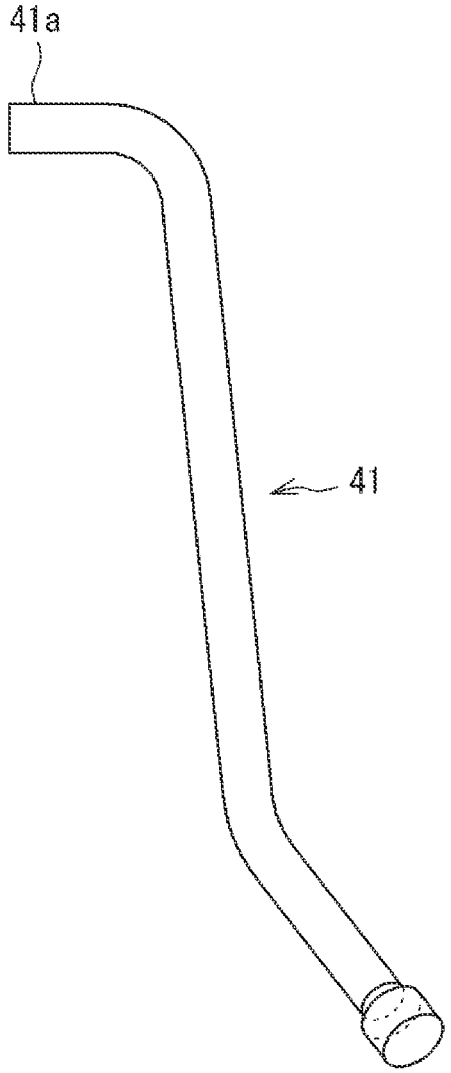
FIG. 8 is an explanatory view of an example of a thin tube.

In one or more embodiments, a thin tube 41 made of copper is connected to an outer peripheral surface of the third pipe 23 via the copper joint 40. The thin tube 41 can be used as a service port, and is used to attach functional components such as a pressure sensor at the time of maintenance or inspection of the air conditioner device A. One end side (tip side) of the thin tube 41 is subjected to flared processing. As shown in FIG. 7, the copper joint 40 has a flared shape in which one end side is enlarged in diameter, and a short pipe portion 40*a* that is not flared is inserted into a hole (not shown) defined in the third pipe 23. Then, the other end 41*a* (end portion opposite to the one end side subjected to the flared processing) of the thin tube 41 illustrated in FIG. 8 is inserted into a large-diameter portion 40*b* that is flared of the copper joint 40. The copper joint 40 and the third pipe 23 can be connected by furnace brazing. In addition, the copper joint 40 and the thin tube 41 made of copper can be connected by manual brazing.

If the thin tube 41 is made of stainless steel, the thin tube can be brazed by furnace brazing together with other pipes and the like as described above. However, since the diameter of the thin tube 41 is smaller than those of the other refrigerant pipes, when the thin tube 41 is made of stainless steel, there is an adverse effect that the manufacturing cost increases in order to obtain predetermined accuracy. Therefore, in one or more embodiments, the thin tube 41 is made of copper, and only the joint 40 made of copper is connected to the refrigerant pipes by furnace brazing. As a result, the thin tube 41 can be connected to the refrigerant pipes via the joint 40 by manual brazing without reducing the strength of the thin tube 41.

In one or more embodiments, the end portion 21*c* of the first pipe 21*b* opposite to an end portion connected to the muffler 15 has a downward posture in the installed state of the switching mechanism C, and the end portion 21*c* is connected to the discharge portion 4*b* of the compressor 4 in the downward posture. Setting the end portion 21*c* of the first pipe 21 in the downward posture facilitates work such as brazing for connecting the end portion 21*c* to the discharge portion 4*b* of the compressor 4 constituted by an upward pipe.

Further, in one or more embodiments, the end portion 22*a* of the second pipe 22 opposite to an end portion connected to the four-way switching valve 16 has a downward posture in the installed state of the switching mechanism C, and the end portion 22*a* is connected to the connecting pipe Ila of the accumulator 11 in the downward posture. Setting the end portion 22*a* of the second pipe 22 in the downward posture facilitates work such as brazing for connecting the end portion 22*a* to the connecting pipe Ila of the accumulator 11 constituted by an upward pipe.

In one or more embodiments, the end portion 24*a* of the fourth pipe 24 opposite to an end portion connected to the four-way switching valve 16 has a downward posture in the installed state of the switching mechanism C, and the end portion 24*a* is connected to the gas shutoff valve 17 in the downward posture. Setting the end portion 24*a* of the fourth pipe 24 in the downward posture facilitates work such as brazing for connecting the end portion 21*a* to a connecting portion (not illustrated) constituted by an upward short pipe of the gas shutoff valve 17.

In one or more embodiments, the four-way switching valve 16 and the first to fourth pipes 21, 22, 23, and 24 connected to the four-way switching valve 16 are made of stainless steel, and these pipes are connected to connecting pipes provided for components such as the compressor 4, the oil separator 12, and the accumulator 11. Further, in one or more embodiments, the connecting pipes of the compressor 4, the oil separator 12, and the accumulator 11 are also made of stainless steel. At the time of assembling the outdoor unit 2 or at the time of maintenance such as component replacement, an operation of manual brazing the first to fourth pipes 21, 22, 23, and 24 made of stainless steel and the connecting pipe and the like of the compressor 4 also made of stainless steel may occur. In this case, the operation of brazing a pipe made of stainless steel requires an operation of removing an oxide film on its surface and the like, and thus the operation becomes complicated. However, in one or more embodiments, a copper connecting portion is provided at each of the end portions 21*c*, 22*a*, 23*a*, and 24*a* of the first to fourth pipes 21, 22, 23, and 24 on a side opposite to end portions connected to the four-way switching valve 16, and a copper portion is provided at an end portion of the connecting pipe of the compressor 4 or the like on a side opposite to an end portion connected to the compressor 4.

Figure 9:
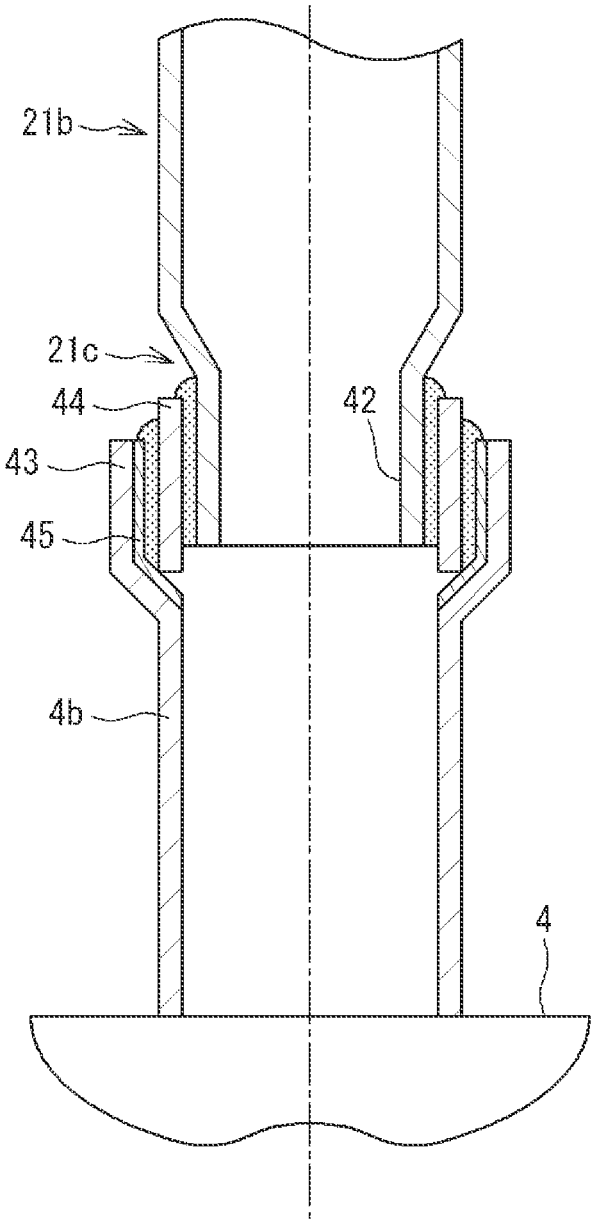
FIG. 9 is an explanatory view of an example of a connecting portion between pipes that are made of stainless steel.

FIG. 9 is an explanatory view of an example of a connecting portion between the pipes that are made of stainless steel. FIG. 9 illustrates the connecting portion between the end portion 21*c* of the first pipe 21*b* and the discharge portion 4*b* of the compressor 4, and the end portion 21*c* of the first pipe 21*b* made of stainless steel has a small-diameter portion 42 having a reduced diameter. On the other hand, an end portion of the discharge portion 4*b* of the compressor 4 on a side opposite to an end portion connected to the compressor 4 has a large-diameter portion 43 having an enlarged diameter. A short pipe 44 made of copper as the connecting portion is fixed to an outer periphery of the small-diameter portion 42 by furnace brazing.

The furnace brazing is a method of performing brazing in a predetermined gas atmosphere within a continuous furnace or the like. The predetermined gas atmosphere is, for example, a hydrogen gas atmosphere in which an oxide film can be removed. Therefore, it is possible to perform brazing of stainless steel without using flux. As a result, an operation of removing flux after brazing is also unnecessary. With the furnace brazing, it is possible to easily manage brazing temperature and brazing time, and thus the brazing can be performed at temperature and time with which occurrence of sensitization can be suppressed.

On the other hand, a copper plating layer 45 which is a copper portion is disposed on an inner peripheral surface of the large-diameter portion 43. The end portion 21*c* of the first pipe 21*b* and the discharge portion 4*b* of the compressor 4 can be connected to each other by brazing the copper short pipe 44 and the copper plating layer 45, and can be easily connected to each other by using conventional copper brazing. Contrary to the example shown in FIG. 9, a plating layer may be disposed on the outer periphery of the small-diameter portion 42, and a short pipe made of copper may be provided on an inner periphery of the large-diameter portion 43. In this case, the plating layer on the outer periphery of the small-diameter portion 42 constitutes the connecting portion, and the copper short pipe on the inner periphery of the large-diameter portion 43 constitutes the copper portion.

Conventionally, both the connection between the pipe and the four-way switching valve and the connection between the pipe and the component have been performed by manual brazing. However, in one or more embodiments, it is sufficient to connect the switching mechanism in which the pipe and the four-way switching valve are assembled to the component by brazing, and therefore the air conditioner can be easily assembled.

Figure 10:
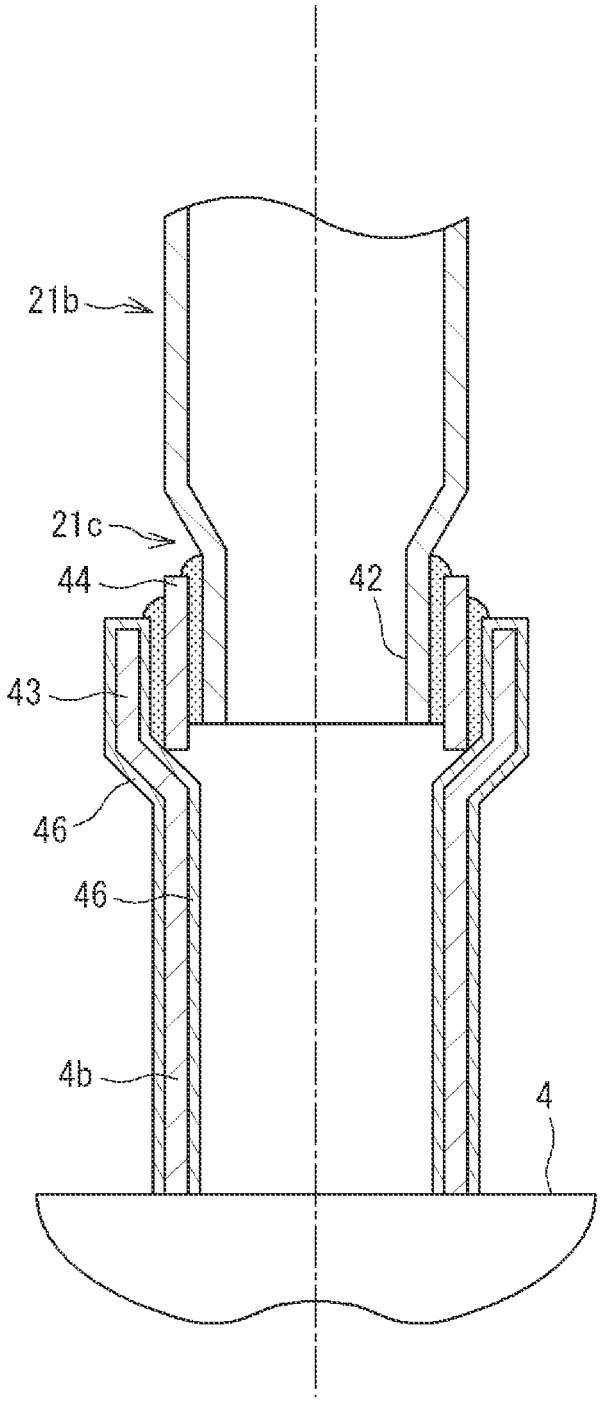
FIG. 10 is an explanatory view of another example of the connecting portion between the pipes made of stainless steel.

FIG. 10 is an explanatory view of another example of the connecting portion between the pipes made of stainless steel. In the example illustrated in FIG. 9, the copper plating layer 45 is disposed only on the inner periphery of the large-diameter portion 43, but, in the present example, a copper plating layer 46 is disposed on an entire tube constituting the discharge portion 4*b*. In this example, the entire tube may be immersed in a plating bath, and therefore the plating operation is easily performed. The short pipe 44 made of copper as the connecting portion provided at, for example, the end portion 21*c* of the first pipe 21*b* described above is a member used for connecting the stainless pipes to each other, and is not a member for causing the refrigerant to flow. The first to fourth pipes in the present disclosure is made of stainless steel, and a portion where a copper pipe alone constitutes the refrigerant pipe is not included.

[Effects of Embodiments]

In the refrigeration apparatus, if components such as the four-way switching valve constituting the refrigeration apparatus are made of stainless steel, when vibration generated during transportation or operation of the refrigeration apparatus is transmitted, stress concentrates on a copper pipe portion having rigidity lower than that of stainless steel, and the pipe may be damaged. Therefore, one or more embodiments of the present disclosure provide a refrigeration apparatus capable of improving resistance to vibration.

In the air conditioner according to the above-described embodiments, the first pipe 21 that causes the refrigerant to flow between the four-way switching valve 16 made of stainless steel and the discharge portion 4*b* of the compressor 4, and the second pipe 22 that causes the refrigerant to flow between the four-way switching valve 16 and the accumulator 11 are pipes made of stainless steel having higher rigidity than copper pipes. As a result, it is possible to improve resistance of the air conditioner including the compressor 4 to vibration generated during transportation or the operation of the air conditioner. Components such as the compressor 4 and the accumulator 11 are usually fixed to the bottom plate of the outdoor unit 2, but the four-way switching valve 16 is disposed at a position separated upward from the bottom plate, and the four-way switching valve 16 itself is not fixed to the bottom plate or the like. Therefore, during transportation, operation, or the like of the air conditioner, the four-way switching valve 16 is more susceptible to vibration than other components.

In addition to the first to second pipes connected to the compressor 4, the third pipe 23 and the fourth pipe 24, which are other pipes connected to the four-way switching valve 16, are also made of stainless steel, and thus the resistance of the air conditioner to vibration generated during transportation, operation, or the like can be further improved.

Moreover, the first pipe 21 that causes the refrigerant to flow between the four-way switching valve 16 and the discharge portion 4*b* of the compressor 4 via the oil separator 12 is made of stainless steel having higher rigidity than a copper pipe. Thus, the resistance of the air conditioner to vibration generated during transportation, operation, or the like can be improved.

Further, the first pipe 21 that causes the refrigerant to flow between the four-way switching valve 16 and the discharge portion 4*b* of the compressor 4 via the muffler 15 is made of stainless steel having higher rigidity than a copper pipe. Thus, the resistance of the air conditioner to vibration generated during transportation, operation, or the like can be improved.

In addition, the second pipe 22 and the refrigerant pipe 38 that cause the refrigerant to flow between the four-way switching valve 16 and the suction portion 4*a* of the compressor 4 via the accumulator 11 are made of stainless steel having higher rigidity than copper pipes. Thus, the resistance of the air conditioner to vibration generated during transportation, operation, or the like can be improved.

Further, since the third pipe 23 connected to the gas header of the outdoor heat exchanger 7 is made of stainless steel, the resistance of the air conditioner to vibration generated during transportation, operation, or the like can be improved.

Moreover, the fourth pipe 24 connected to the gas shutoff valve 17 is made of stainless steel, the resistance of the air conditioner to vibration generated during transportation, operation, or the like can be improved.

In the refrigeration apparatus, a copper thin tube 41 may be connected to at least one of the first to fourth pipes 21, 22, 23, 24 via a copper joint 40. For example, a copper thin tube 41 as a service port can be connected to the third pipe 23 connected to the gas header 19 of the heat exchanger 7 via the copper joint. In addition, the copper thin tube 41 as a charge port can be connected to the fourth pipe 24 connected to the gas shutoff valve 17 via the copper joint 40.

In the above-described embodiments, the short pipe 44, which is a copper connecting portion, is provided at each of the end portions 21*c*, 22*a*, 23*a*, and 24*a* of the first to fourth pipes 21, 22, 23, and 24 on the opposite side to end portions connected to the four-way switching valve 16. By providing the copper short pipe 44, in a case where a copper portion is provided at each of the pipe end portions connected to the end portions 21*c*, 22*a*, 23*a*, and 24*a*, the copper short pipe 44 and the copper portion can be connected by brazing or the like.

Further, when a copper portion is provided at each of the end portions of the connecting pipes made of stainless steel of the compressor 4, the accumulator 11, and the oil separator 12, and the short pipe 44, which is a copper connecting portion, is provided at each of the end portions 21*c*, 22*a*, 23*a*, and 24*a* of the first to fourth pipes 21, 22, 23, and 24 made of stainless steel, the copper short pipe 44 and the copper portion can be connected by brazing or the like.

[Other Modifications]

The present disclosure is not limited to the foregoing embodiments, and various modifications may be made within the claims.

For example, in the above-described embodiments, all of the first to fourth pipes are made of stainless pipe. However, the first pipe 21 connected to the discharge portion 4*b* of the compressor 4 and the second pipe 22 connected to the accumulator 11 may be made of stainless pipe, and the third pipe 23 and the fourth pipe 24 may be made of a material other than stainless steel such as copper, for example.

In the embodiments described above, the refrigerant pipes (first to fourth pipes) connected to the four-way switching valve 16 are made of stainless steel, but other refrigerant pipes, for example, a refrigerant pipe connecting the liquid shutoff valve 18 and the outdoor heat exchanger 7 may also be made of stainless steel.

Further, in the above-described embodiments, the accumulator is provided on the suction side of the compressor, but the air conditioner may not include such an accumulator. In this case, the pipe that causes the refrigerant to flow between the four-way switching valve and the compressor is made of stainless steel.

In the embodiments described above, the refrigerant pipe 38 connecting the accumulator and the compressor is made of stainless steel, but may be made of copper.

Moreover, in the embodiments described above, the thin tube made of copper is connected to the third pipe via the copper joint, and the thin tube is used as a service port. However, similarly, a copper pipe may be connected to the first pipe via a copper joint, and a high pressure sensor may be connected to the thin tube. Further, a thin tube made of copper may be connected to the second pipe via a copper joint, and a low-pressure sensor may be connected to the thin tube. In addition, a thin tube made of copper may be connected to the fourth pipe via a copper joint, and the thin tube may be used as a charge port.

Further, in the above-described embodiments, in the connection between the end portions of the first to fourth pipes and the end portions of the connecting pipes of the compressor and the like, the short pipes made of copper are provided at one of the end portions and the copper plating layers are provided at the other of the end portions. However, the short pipes made of copper may be provided at both end portions, or the copper plating layers may be provided at both end portions.

Moreover, in the above-described embodiments, the air conditioner of a separate type or a separation type in which the indoor unit and the outdoor unit are provided as separate units has been exemplified. However, the air conditioner which is the refrigeration apparatus of the present disclosure is not limited thereto. An air conditioner of a type in which a compressor, a condenser, an evaporator, a fan, and the like, which are components of the air conditioner, are integrated and housed in one casing is also included in the refrigeration apparatus of the present disclosure.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: INDOOR UNIT
2: OUTDOOR UNIT

2*a*: CASING
3: REFRIGERANT CIRCUIT
4: COMPRESSOR
4*a*: SUCTION PORTION
4*b*: DISCHARGE PORTION
5: INDOOR HEAT EXCHANGER
6: ELECTRONIC EXPANSION VALVE
7: OUTDOOR HEAT EXCHANGER
8: REFRIGERANT PIPE
9: INDOOR FAN
10: OUTDOOR FAN
11: ACCUMULATOR
12: OIL SEPARATOR
13: VALVE
14: OIL RETURN PIPE
15: MUFFLER
16: FOUR-WAY SWITCHING VALVE
17: GAS SHUTOFF VALVE
18: LIQUID SHUTOFF VALVE
21: FIRST PIPE
21*a*: FIRST PIPE
21*b*: FIRST PIPE
21*c*: END PORTION
22: SECOND PIPE
22*a*: END PORTION
23: THIRD PIPE
23*a*: END PORTION
24: FOURTH PIPE
24*a*: END PORTION
31: FIRST PORT
32: SECOND PORT
33: THIRD PORT
34: FOURTH PORT
35: BYPASS PORTION
36: LOOP PORTION
40: COPPER JOINT
40*a*: SHORT PIPE PORTION
40*b*: LARGE-DIAMETER PORTION
41: THIN TUBE
42: SMALL-DIAMETER PORTION
43: LARGE-DIAMETER PORTION
44: SHORT PIPE
45: PLATING LAYER
46: PLATING LAYER
A: AIR CONDITIONER (REFRIGERATION APPARATUS)
B: AIR CONDITIONER (REFRIGERATION APPARATUS)
C: SWITCHING MECHANISM

What is claimed is:

1. A refrigeration apparatus comprising:
a casing that houses a compressor therein;
a four-way switching valve;
an accumulator;
a first pipe that:
causes a refrigerant to flow between the four-way switching valve and a discharge portion of the compressor, and
comprises:
a stainless steel pipe portion; and
a tubular copper connecting portion; and
a second pipe that causes a refrigerant to flow between the four-way switching valve and the accumulator, wherein
the four-way switching valve and the second pipe are made of stainless steel,
the tubular copper connecting portion is disposed at a first end of the first pipe opposite to a second end of the first pipe connected to the four-way switching valve,
the tubular copper connecting portion is connected to an end of an external pipe, and
the first end of the stainless steel pipe portion of the first pipe, the tubular copper connecting portion, and the end of the external pipe overlap with each other in a pipe radial direction of the tubular copper connecting portion.

2. The refrigeration apparatus according to claim 1, further comprising:
a third pipe made of stainless steel and that is connected to the four-way switching valve; and
a fourth pipe made of stainless steel and that is connected to the four-way switching valve.

3. The refrigeration apparatus according to claim 1, wherein the first pipe causes a refrigerant to flow between the four-way switching valve and the compressor via an oil separator.

4. The refrigeration apparatus according to claim 1, wherein the first pipe causes a refrigerant to flow between the four-way switching valve and the compressor via a muffler.

5. The refrigeration apparatus according to claim 2, wherein the third pipe is connected to a gas header of a heat exchanger.

6. The refrigeration apparatus according to claim 2, wherein the fourth pipe is connected to a gas shutoff valve.

7. The refrigeration apparatus according to claim 2, further comprising:
a copper joint; and
a copper tube that is connected to at least one of the first pipe, the second pipe, the third pipe, and the fourth pipe via the copper joint.

8. The refrigeration apparatus according to claim 2, wherein each of the first pipe, the second pipe, the third pipe, and the fourth pipe comprises a copper connecting portion at a first end opposite to a second end connected to the four-way switching valve.

* * * * *